United States Patent [19]

Droz

[11] 4,370,644

[45] Jan. 25, 1983

[54] ALARM DEVICE FOR A DOOR, AUTOMATICALLY SWITCHED OFF DURING A LICIT ACCESS

[76] Inventor: Serge-André Droz, 14 avenue du Lignon, 1219 Le Lignon, Switzerland

[21] Appl. No.: 252,977

[22] PCT Filed: Jan. 31, 1980

[86] PCT No.: PCT/CH80/00012

§ 371 Date: Oct. 1, 1980

§ 102(e) Date: Sep. 29, 1980

[87] PCT Pub. No.: WO80/01617

PCT Pub. Date: Aug. 7, 1980

[30] Foreign Application Priority Data

Feb. 1, 1979 [CH] Switzerland ..... 991/79

[51] Int. Cl.[3] ..... G08B 13/08; G08B 23/00

[52] U.S. Cl. ..... 340/528; 340/542; 340/545; 200/61.62; 200/61.64; 200/61.67; 116/86

[58] Field of Search ..... 340/528, 545, 541, 546, 340/547, 521, 522, 523, 542, 543; 200/61.62, 61.64, 61.67–61.7, 61.81; 116/6, 12, 15, 75, 85, 86, 100

[56] References Cited

U.S. PATENT DOCUMENTS

| | | | |
|---|---|---|---|
| 3,653,022 | 3/1972 | Tall | 340/545 |
| 3,696,374 | 10/1972 | Vosbikian et al. | 340/528 |
| 3,848,242 | 11/1974 | Campagna | 340/545 |
| 4,170,005 | 10/1979 | Duke | 340/545 |

FOREIGN PATENT DOCUMENTS

| | | | |
|---|---|---|---|
| 569334 | 11/1975 | Fed. Rep. of Germany | 340/545 |
| 2125436 | 9/1972 | France | 340/545 |

*Primary Examiner*—John W. Caldwell, Sr.
*Assistant Examiner*—Donnie Lee Crosland
*Attorney, Agent, or Firm*—Eugene E. Geoffrey, Jr.

[57] ABSTRACT

An alarm device for doors having in series an electric supply, such as batteries, three switches and a relay. The relay is locked upon the simultaneous closing of the three switches and actuates an alarm circuit. The first and second switches are respectively closed and open when the door is closed and respectively open and closed when the door is fully open. The three switches are closed during the opening and closing of the door and when the door is ajar and the door bolt is retracted. The third switch is controlled by the bolt and is closed except when the bolt is retracted.

9 Claims, 14 Drawing Figures

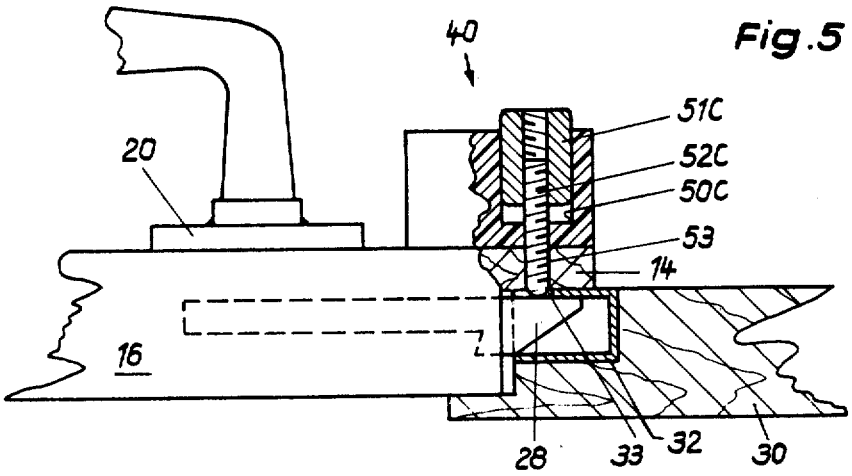
Fig.5
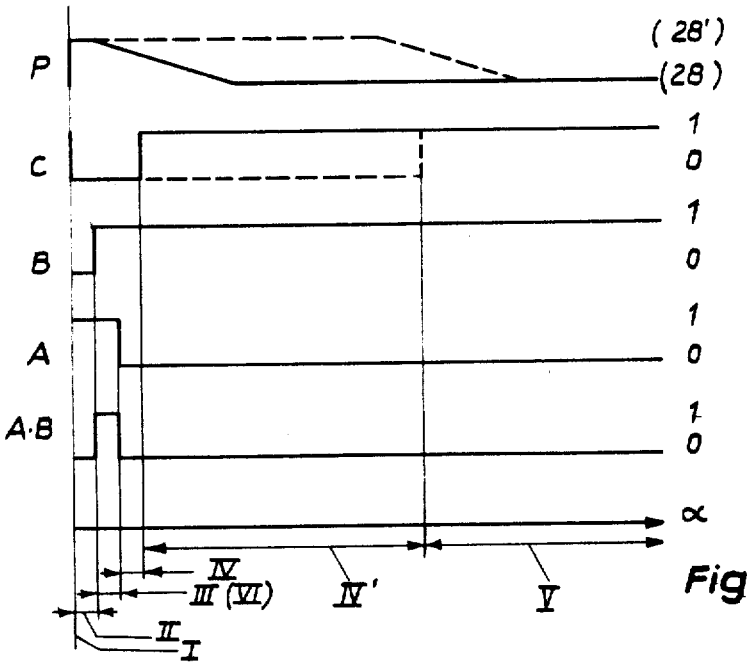
Fig.9
Fig.8
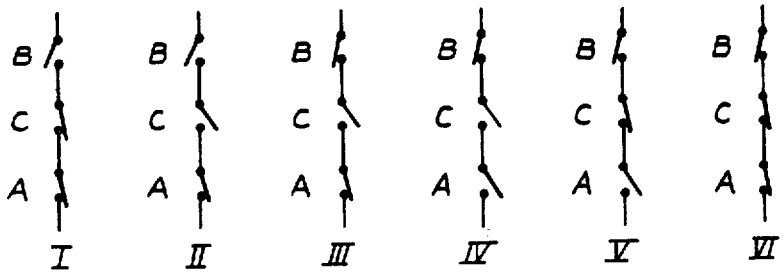

Fig. 10
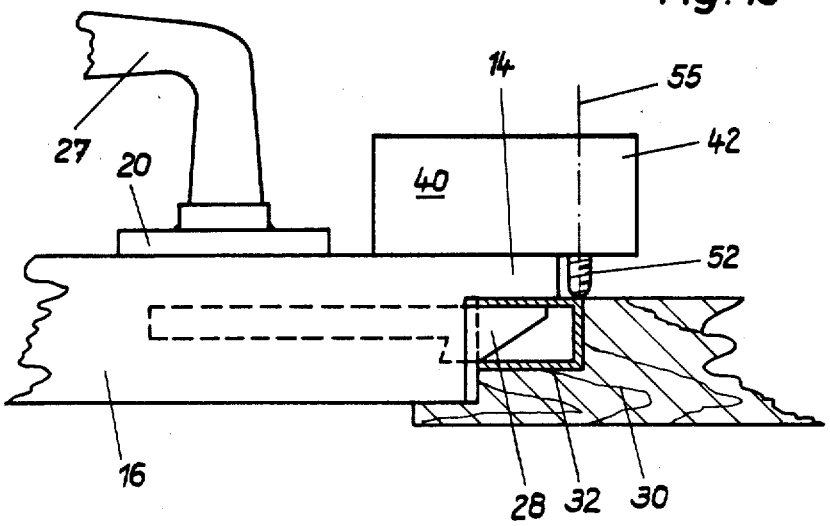
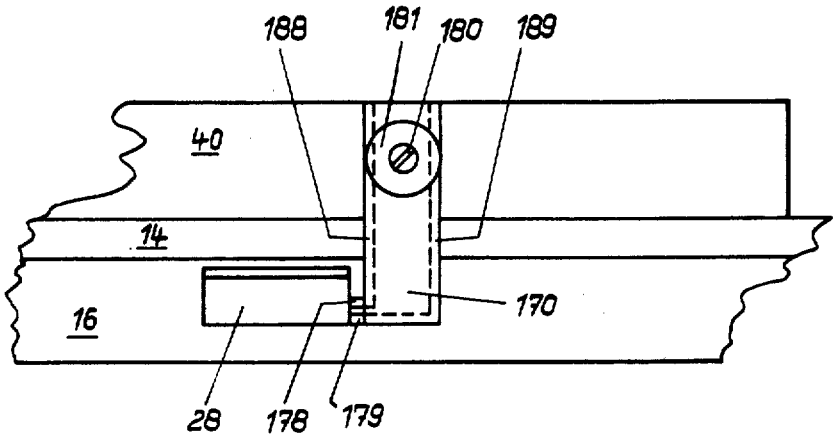
Fig. 14

ALARM DEVICE FOR A DOOR, AUTOMATICALLY SWITCHED OFF DURING A LICIT ACCESS

The invention relates to an alarm device for a door, automatically switched off during a licit access, either that use of a key is made, either that the lock is already unlocked.

This type of alarm device avoids the inconvenience of certain prior devices which had to be switched on only after the authorized persons had left the premises, for example every evening after the closing of a working place or a shop, or when leaving a house, for example, for a trip. One is exposed to an inadvertent alarm if one forgets to set the device out of operation before entering again in the protected premises and, conversely, one is exposed to a break-in if one forgets to switch on the device before leaving the premises.

Alarm devices with automatic switch-off avoiding this inconvenience are already known, for example that disclosed in the Swiss Pat. No. 569.334, in reference to FIG. 5 of this patent, reproduced in FIG. 1 of the drawing annexed herewith. The switch SW1 is arranged in the staple on the jamb-lining, so as to open when the lock bolt is manipulated, cutting off the power supply line from the current source S. The switch SW2 is mounted for example on the top of the jamb-lining and opens if the door is opened or forced. If the door is normally opened, with the use of a key, the opening of SW2 has no effect since SW1, open, cuts off the supply. If, on the other hand, the door is forced without handling the lock, the opening of SW2 starts off the alarm since the relay Ry has contacts C1, C2 which close the alarm circuit passing through the buzzer Bz as soon as the coil Co ceases from being energized. In other words, the relay Ry is closed when it is at rest.

However, this solution presents some disadvantages. As a fact, since the relay is closed at rest, the coil Co which maintains the contacts C1 and C2 spaced apart as long as it is energized, consumes electrical current, and it does so during the whole time when the premises are locked. There results a waste of electric energy. This disadvantage eliminates practically the possibility of building the device with a compact shape comprising its own supply, for example a cell, which would be quickly down particularly at the moment when it would be most needed to generate the alarm signal.

Further, the contacts are arranged on the jamb-lining, which makes the mounting less practical.

The present invention aims at solving problems of this kind by proposing a device where the relay does not take current when at rest and where the contacts are provided on the leaf of the door which makes possible a compact embodiment and makes easier the mounting of the device.

The alarm device according to the invention is characterized in that it comprises a control circuit comprising, in series, an electric energy source, three switches, the first and the second being respectively closed and open when the door is closed and, conversely, open and closed when the door is wide open, but simultaneously closed for the handling phase of the door when, the door being just ajar, the bolt is necessarily retracted, the third switch being controlled by the bolt and closed except when the bolt is retracted, and a relay being interlocked in a working position during the simultaneous closing of the three switches, and an alarm circuit actuated by the relay when said relay is in a working position. Thus, the device starts off the alarm if the door is forced without the pin being retracted.

It is to be noted that the control by switches set in series and a working contact relay, to save electric energy, raises a particular problem that the present invention has solved, the problem is the following: if one takes one's inspiration from a conventional solution, then a switch will close when the door is open (either licitly, either by breakingin) and, to differentiate these two cases, a second switch will be arranged in series with the first one, open if the bolt is retracted, if not, closed. Now, doors exist having a single bolt, controlled both by the lock and by the door handle. Then, in this case, when the door is wide open and the handle is released, the bolt comes out and the alarm is started off inadvertently. Such a circuit is not, therefore, appropriate and the solution to this problem is not obvious.

It is all the more remarkable that the particular arrangement of the device according to the invention avoids completely this problem.

The invention will be better understood when reading the description of a few forms of execution given hereafter as way of example, in reference to the drawings annexed wherein:

FIG. 1 shows the electric diagram of a known prior art device mentioned hereabove, FIG. 2 shows an alarm device mounted on a door, FIG. 3 shows a side view of the door and of the device of FIG. 2, FIG. 4 is a view similar to that of FIG. 3, the door being closed, a portion of the jamb-lining showing in cross-section, FIG. 5 is a view according to a partial horizontal cross-section showing the arrangement of the switch C.

Figure 1:
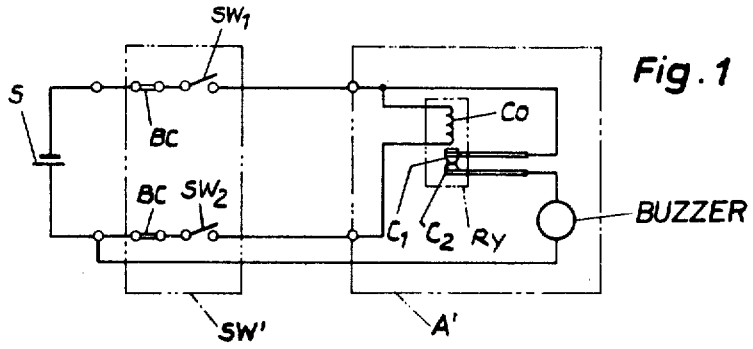
Figure 2:
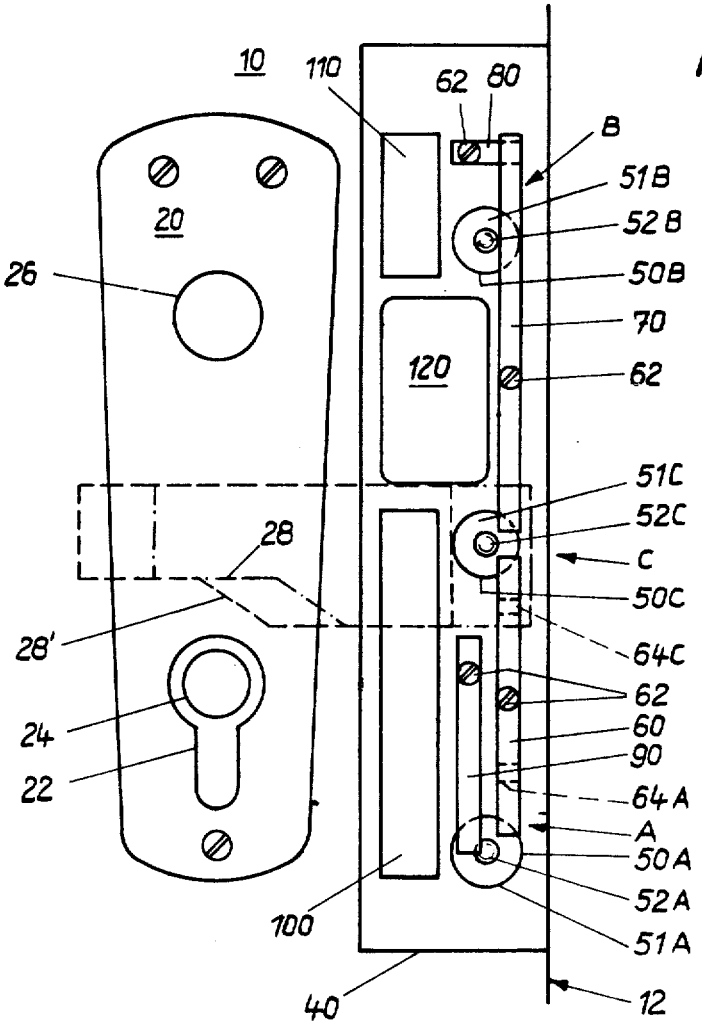
Figure 3:
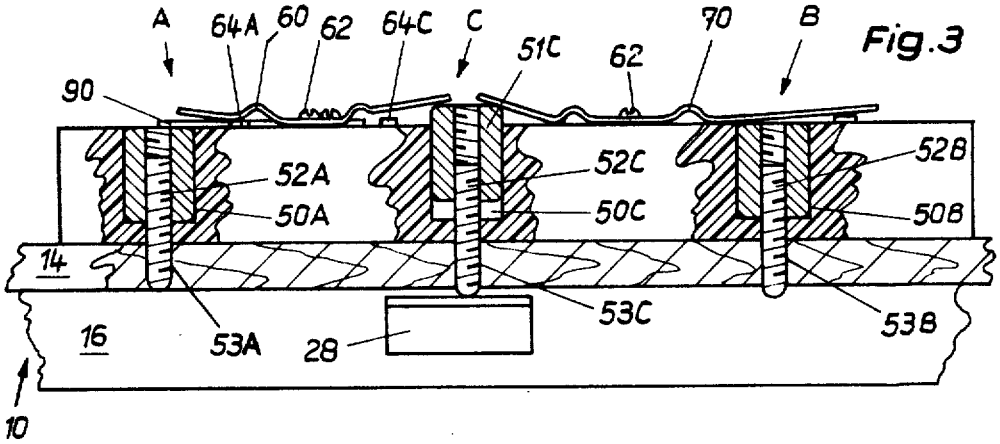
Figure 12:
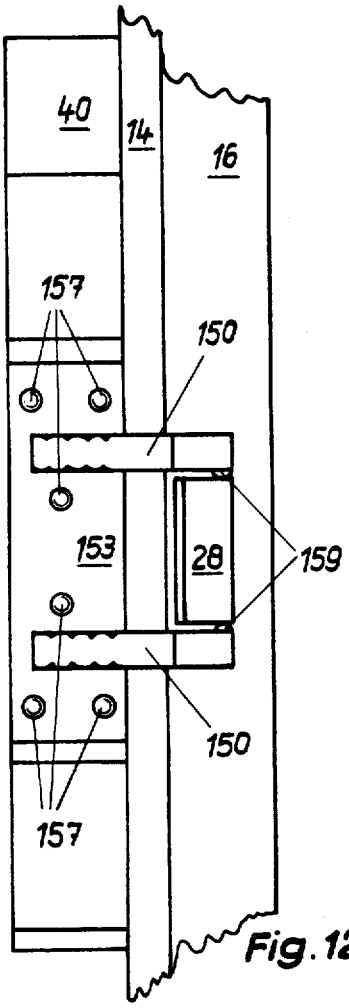
Figure 13:
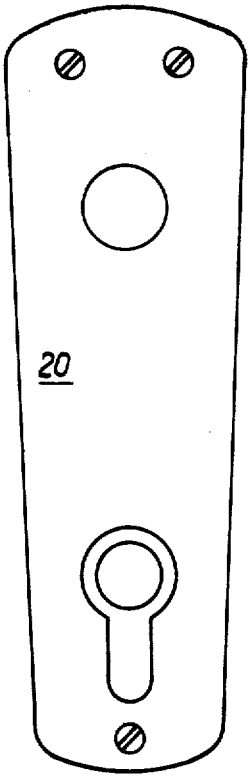
Figure 11:
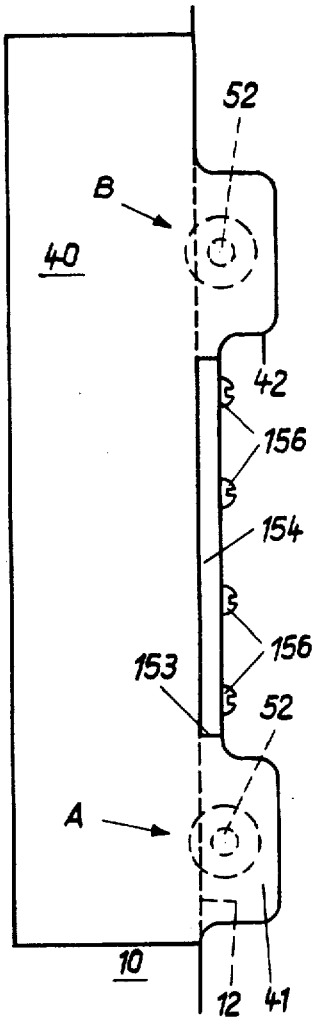
Figure 11:
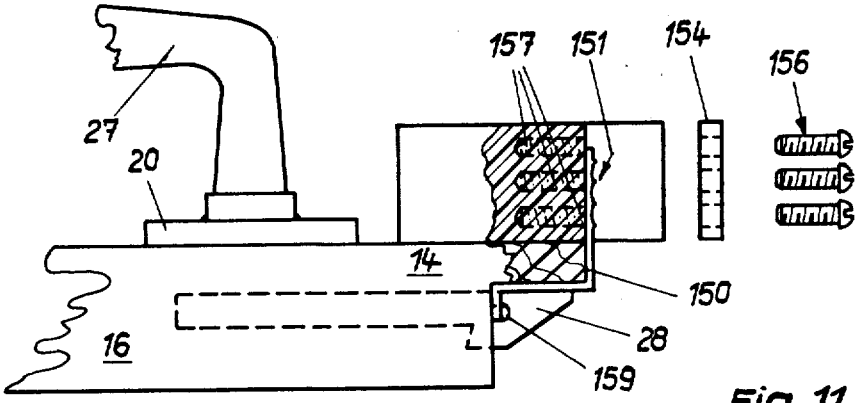

FIG. 8 shows diagrammatically the state of the switches for different phases of the handling of the door, FIG. 9 is a diagram showing the behaviour of the switches during the handling of the door, FIG. 10 is a horizontal cross-section similar to that of FIG. 5, showing another form of execution of the device, FIG. 11 is a horizontal cross-section similar to that of FIG. 10, showing an arrangement of the switch C, FIG. 12 shows an arrangement of the switch C according to a view similar to that of FIG. 3, FIG. 13 shows a form of execution of the device according to a view similar to that of FIG. 2, FIG. 14 shows, according to a view similar to that of FIG. 12, an alternative of the arrangement of the switch C.

FIG. 2 shows diagrammatically an alarm device 40 mounted on a door 10. The door 10 comprises conventionally a lock 22 with a cylinder 24, controlling a bolt 28, shown also in a retracted position 28'. The bolt 28 is also controlled by the handle of the door. On the cleaning plate 20, the opening 26 may be seen which corresponds to the handle of the door. The device 40, represented diagrammatically, comprises an alarm member 120, for example a buzzer, or a remote control for the alarm signal, or an automatic call control. The alarm member 120 is controlled by a relay 110, and in 100 are provided cells or batteries for the supply of electric energy. Some secondary details of the circuit and certain connections are not shown. The device 40 comprises three switches A, B and C. Each of these switches comprises a mechanical part comprising a cylindrical socket 51 movable axially in a housing 50 provided in the device 40. The socket 51 comprises an axial threaded hole wherein a threaded pin or rod 52 is adjustably engaged.

Figure 4:
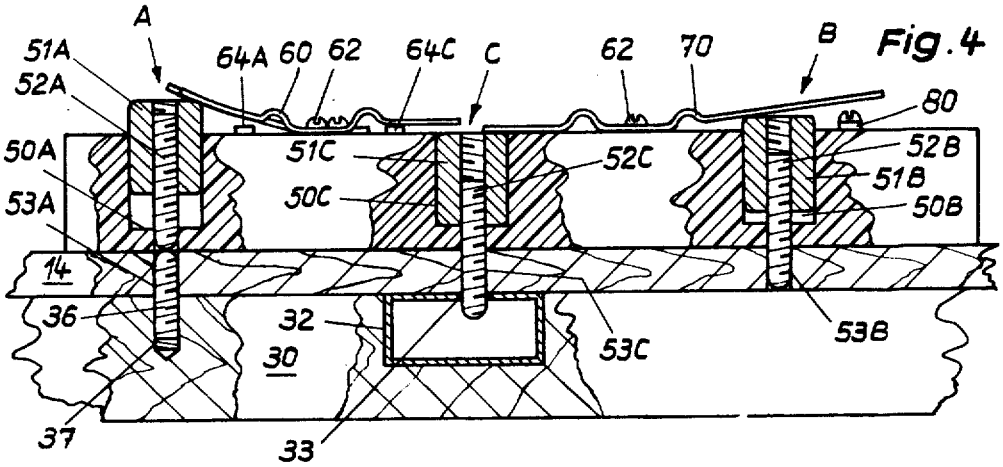

The state of the switches A and B depends on the position of the door, and the state of the switch C depends on the position of the bolt, as shown in FIGS. 3 and 4.

The sockets of the respective are pushed back by resilient strips or knives 60, 70 and 90, which, at the same time, act as electric contact elements. The knife 90 bears on the socket 51A of the switch A. The knife is made of metal and it is secured by a screw 62 to the box or casing of the device 40, which is made of an insulating material, for example plastic.

A portion of the knife 60 also bears on the socket 51A. The socket is made of conductive material or, at least, comprises a conductive element where it co-operates with the knives 90 and 60. Thus, when the socket 51A is projected, it establishes the contact between the knives 90 and 60. However, when the socket 51A is completely pushed back in its housing 50A by the knife 90, the contact is cut off since the knife 60 is retained by a stop 64A and therefore does not touch the socket 51A.

Another portion of the strip 60 bears on the socket 51C of the switch C and is also retained by a stop 64C. A portion of another strip 70 bears also on the socket 51C. The pin or rod 52C abuts against the bolt 28 when this bolt is in a normal position, that is to say, projected with respect to the edge of the door. When the bolt is retracted in 28', the pin 52C is not abutting any longer, so that the strip 70 may push back the socket 51C completely in its housing 50C. The contact between the strip 70 and the strip 60 is then cut off, due to the fact that the strip 60 is retained by a stop 64C, in a similar way to the case of the switch A. The other portion of the strip 70 bears on the socket 51B. When this socket is completely pushed back in its housing, the strip may bear on a terminal 80. When the socket 51B is sufficiently projected, the contact between the strip 70 and the terminal 80 is cut off.

The pins 52A, B and C come out of the device 40 at the base of the respective housings 50A, B and C and engage in the respective holes 53A, B and C provided for this purpose in the edge 14 of the door 10. To determine the location of the holes to be drilled, a template may be used or the casing or box of the device 40 may be used, the holes provided at the bottom of the housings 50 allowing to position precisely the locations of the holes 53 to be drilled in the door. If the box is built with a bottom plate (not shown), the latter may be used as a template.

Thus, there are three switches in series: A, B and C.

FIG. 3 shows the door seen sideways with partial cross-sections. Also represented are the states of the switches when the door is wide open and the bolt 28 is projected, the handle of the door having been released. The switch A is then open and the switches B and C closed.

FIG. 4 shows the door closed and the jamb-lining in a partial cross-section according to a plane passing by the access of the pins 52 of the switches. On this cross-section, a portion of the jamb-lining 30 is shown with the staple 32 in which the bolt 28 (not shown in this figure) is intended to be engaged. The hole 53C is extended by a hole 33 provided in the staple, and possibly drilled at the same time as the hole 53C. On this figure, the bolt is supposed to be retracted, so that the pin 52C is no longer abutting which allows the socket 51C to be completely pushed back in its housing by the strip 70. Due to the presence of the stop 64C, the strip 60 may not be in contact with the socket 51C: the switch C is therefore open.

In FIG. 4, the pin 52B of the switch B bears simply against the surface of the jamb-lining 30, forcing the socket 51B to come out, which breaks the contact between the terminal 80 and the strip 70.

Facing the pin 52A of the switch A is a peg 36 housed in a hole 37 extending the hole 53A provided in the edge or flange 14 of the door 10 and, possibly drilled both at the same time. When the door is closed, this peg pushes the pin 52A back so that the socket 51A coming out of its housing establishes the contact between the strips 90 and 60. The peg is intended to act as follows. When the door is wide open (FIG. 3), the fact that the pin 52B is projected has no important consequence. If it is pushed back accidentally or voluntarily by a child, for example, this will open the switch B, but it is already in series with an open switch: A. On the other hand, one should not be able to actuate, accidentally, in such a way, the switch A, the only one which remains open, because by closing it, one would inadvertently operate the alarm. Thus, the pin 53A must not be projected when the door is open. This means that it may not be pushed back by the surface of the jamb-lining 14. It is then the peg 36 which causes the movement of the pin 52A.

As mentioned above, each pin 52 is engaged adjustably in the axial threaded hole of the corresponding socket 51. The socket 51 may comprise an outer axial groove co-operating with a corresponding axial groove in the housing 50 to prevent the socket from rotating when adjusting the threaded pin by screwing (not shown in the drawing). This adjustment allows to obtain the predetermined behaviour of the switches, as described more particularly in reference to FIGS. 8 and 9.

FIG. 5 shows a partial horizontal cross-section passing by the axis of the socket 51C; the bolt is represented in a non-retracted position and it is engaged in the staple 32. The pin or rod 52C passes through the hole 33 of the staple 32 and is abutting onto the bolt 28. The socket 51C is therefore pushed back in a projecting position outside its housing 50C. The switch C is therefore closed.

Figure 6:
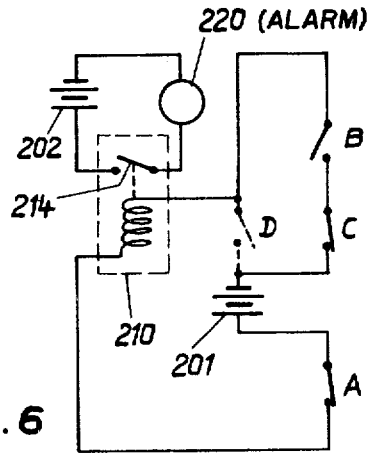
FIG. 6 shows a possible electric diagram for the device.

FIG. 6 shows a possible electric diagram for the alarm device. The switches A, B and C are in the respective states that they have when the door is closed and the pin in a normal position. The three switches are in series; an electric energy source 201 is interposed in the series. The circuit is closed by the coil of a relay 210. This relay must be of the irreversible action type. Meaning that if a pulse energizes the coil and, thereby, actuates a controlled switch 214, the latter must not come back to its rest position even if the coil stops being energized. In other words, one pulse is enough for the relay to "stick". To "unstick" the relay, a specific action must be taken, for example unscrew the protection cover and take out the batteries or effect any control action on, for example, an unlocking lever provided on this type of relay.

When the relay 210 is actuated, closing the contact 214, the alarm circuit is energized, alarm circuit which comprises a supply source 202 and an alarm member 220 such as a buzzer or an apparatus controlling an automatic telephone call or actuating at a remote distance an alarm signal.

The source 201 could be positioned elsewhere, in the circuit, and the order of the switches could be modified without changing the principle of the series mounting. As an alternative, an additional switch D may be provided comprised of a particular detector which reacts by closing itself when an attempt to force the lock itself is made. This switch is mounted in parallel with B and C, which are normally open.

Figure 7:
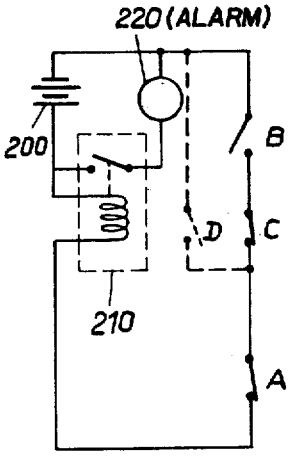
FIG. 7 shows another possible electric diagram.

FIG. 7 shows an alternative where the device 40 comprises only one supply 200. The switch D provided alternatively may be arranged in parallel either with B and C, as shown, either with the whole series B, C, A. The circuit is such that electrical energy is consumed only when the alarm is released. However, a cell or a battery may, in the long run, be discharged without having been used. It is useful to provide on the alarm device 40 a small circuit for the indication of the charge of the cell or battery. This circuit, not shown, would be connected to the terminals of the power supply. It may comprise, for example, a working contact switch controlled by a push button, in series with a voltmeter, or a lamp indicator which is on only if the charge is still sufficient.

FIG. 8 shows the states or conditions of the switches A, B and C in function of the different phases of the handling of a door. In I, the door is closed and the bolt is in a normal position (28, FIG. 5). In II, the handle is actuated, the bolt is retracted and the door still closed (FIG. 4). In III, the door is just ajar. In IV, the door is open more widely, but the bolt is still necessarily retracted. In IV', the bolt may be released. In V, the bolt is released (FIG. 3). In VI, all the switches are closed. This may only happen if the door is forced without having a key. C may therefore only be closed. At the moment when the door is pushed ajar illicitly, for example by forcing it with a lever, the switch B closes before the switch A opens, as in phase III, except that C being also closed, the relay is to be energized and the alarm given. A certain amount of time is required to disassemble the device and reach the cells or batteries or the unlocking lever of the relay, and this time delay is sufficient for the signal to be already transmitted before the author of the breaking-in has the possibility to stop the operation of the device.

FIG. 9 shows diagrammatically the phases I to V according to the angular position $\alpha$ of the door. The curve P is relative to the handling of the bolt. The dotted line indicates that the bolt may be released later than necessary (or that, during the closing, the bolt may be retracted before than necessary). The curves C, B, A are relative to the switches, 1 meaning switch closed, 0 meaning switch open. A.B is the product of the functions A and B.

FIG. 10 shows a form of execution of the device where the switches A, B and C are arranged outside the door, so as to avoid drilling into the door. The switches A and B do not raise any particular problems.

For the switch C, a different arrangement is provided shown in FIGS. 11 to 13. Two contact strips 150 are arranged, one above the bolt, the other under the bolt. These strips are angled so as to conform to the profile of the door. At the end of each of the strips, is a conductive portion 159, slightly projecting and resiliently bearing against the bolt 28 when it is not retracted. The bolt, made of metal, establishes then the contact. When the bolt is retracted, the contact is cut off, as it is provided for the operation of the device. The contact strips 150 co-operate with the bolt 28 to form the switch C.

Each plate is wedged in position against the box of the device 40 by a plate 154 rigidly secured by screws 156. When setting in place the strips 150, when these strips are correctly positioned with respect to the bolt 28, the plate 154 which is of insulating material is screwed. Each strip comprises small teeth 151 which penetrate in the insulating material of the plate upon screwing, thereby rigidly securing the strip.

As an alternative, these teeth 151 could co-operate with a conductive area to establish the electric contact. The electric connections of the strips are not shown, but they do not present any particular difficulty.

FIG. 13 is a similar view to that of FIG. 2. One may notice that the switches A and B are arranged on bosses 41, 42 allowing to avoid drilling the door. The strips 150, not visible in FIG. 13, are held by the plate 154.

FIG. 14 is a view similar to that of FIG. 12 showing an alternative for the execution of the switch C. A single strip 170 carries two contacts 178, 179 co-operating with the bolt 28. Each contact is connected to a conductor, respectively 188 and 189, diagrammatically shown in the figure. The strip 170 is fixed to the box by a screw 180 and a washer 181.

Each conductor could, for example, by comprised of a metal deposit on a plate 170 of insulating material. But it could also be provided a plate 170 conduct and constituting one of the two conductors, for example 189, the other conductor 188 being a metal band stuck, with interposition of insulating material, on the strip 170.

I claim:

1. An alarm device for a door having a lock including a retractable bolt, which device is automatically switched off during a licit access, said alarm device comprising a control circuit including, in series, an electric power source, and first, second and third switches, the first and the second switches being respectively closed and open when the door is closed and, conversely, open and closed when the door is fully open, and simultaneously closed during opening and closing of the door, said retractable bolt on said door functioning for locking and unlocking the door, means coupling said bolt to said third switch whereby said third switch is closed except when the bolt is retracted, a relay interconnected with said switches and actuated upon the simultaneous closing of the three switches, and an alarm circuit connected with said relay and operated when the relay is actuated.

2. An alarm device according to claim 1, wherein said power source is a battery.

3. An alarm device according to claim 2, including means indicating the charge of the battery.

4. An alarm device according to claim 1, wherein said alarm circuit is operated by said electric power source.

5. An alarm device according to claim 1, wherein said control circuit is contained in a box to be mounted on the door.

6. An alarm device according to claim 5, wherein said box also contains the alarm circuit.

7. An alarm device according to claim 1, wherein said alarm circuit includes means for remotely controlling the release of the alarm signal.

8. An alarm device according to claim 1, wherein said alarm circuit includes means for initiating an automatic telephone call.

9. An alarm device according to claim 1, wherein said control circuit includes a fourth switch connected in parallel with at least said second switch and arranged on the lock so as to close when the lock is forced, thus closing said control circuit and actuating said relay.

* * * * *